US008783274B1

(12) United States Patent
Supino

(10) Patent No.: US 8,783,274 B1
(45) Date of Patent: Jul. 22, 2014

(54) APPARATUS FOR ANCHORING UMBRELLAS

(76) Inventor: John Supino, New Milford, NJ (US)

( * ) Notice: Subject to any disclaimer, the term of this patent is extended or adjusted under 35 U.S.C. 154(b) by 285 days.

(21) Appl. No.: 13/239,661

(22) Filed: Sep. 22, 2011

Related U.S. Application Data

(60) Provisional application No. 61/388,996, filed on Oct. 1, 2010.

(51) Int. Cl.
*A45B 3/00* (2006.01)

(52) U.S. Cl.
USPC ..... 135/16; 135/98; 135/118; 248/529; 383/75

(58) Field of Classification Search
USPC ..... 135/16, 96, 98, 118; 248/507–508, 518, 248/519, 529, 530–533, 910; 220/475, 751, 220/754; 383/72, 75, 12, 19, 22
See application file for complete search history.

(56) References Cited

U.S. PATENT DOCUMENTS

| | | | | |
|---|---|---|---|---|
| 3,674,512 | A * | 7/1972 | Andros | 426/130 |
| 4,832,163 | A * | 5/1989 | Levesque | 190/11 |
| 5,326,175 | A * | 7/1994 | Carter | 383/22 |
| 5,452,877 | A * | 9/1995 | Riffle et al. | 248/511 |
| 6,199,570 | B1 * | 3/2001 | Patarra | 135/16 |
| 6,554,149 | B2 * | 4/2003 | Schneider et al. | 220/9.3 |
| 6,986,496 | B2 * | 1/2006 | Roberts et al. | 248/519 |
| 7,168,437 | B2 * | 1/2007 | Bigford | 135/16 |
| D625,508 | S * | 10/2010 | Thurrott et al. | D3/10 |
| 7,946,305 | B1 * | 5/2011 | Mailman | 135/16 |
| 8,424,549 | B1 * | 4/2013 | Goldsmith et al. | 135/120.4 |
| 2012/0011773 | A1 * | 1/2012 | Cross et al. | 47/65.8 |
| 2013/0051707 | A1 * | 2/2013 | Pisano et al. | 383/75 |

* cited by examiner

*Primary Examiner* — Winnie Yip
(74) *Attorney, Agent, or Firm* — Evelyn M. Sommer

(57) ABSTRACT

An apparatus for anchoring an umbrella having a generally cylindrical container structure, having a bottom panel area securely attached to the cylindrical center structure, the bottom panel having a generally concentric opening to the interior of the central structure which is adapted to permit an umbrella pole's lower portion to protrude therefrom for placement on a sand base. A panel with an upper opening is attached to the cylindrical central structure. The upper opening panel is configured to receive an umbrella pole and an amount of sand sufficient to provide support for the pole and ballast for the umbrella. At least one strap is attached at one end of the central structure and is of sufficient length to wrap over the umbrella pole runner and around the pole and through the spokes to secure the umbrella support structure, eliminating wobbling and keeping the umbrella from flying across the sand.

19 Claims, 8 Drawing Sheets

APPARATUS FOR ANCHORING UMBRELLAS

CROSS-REFERENCE TO RELATED APPLICATIONS

This application claims the benefit of co-pending application U.S. Ser. No. 61/388,996 filed Oct. 1, 2010, which is incorporated herein by reference.

FIELD OF THE INVENTION

The present invention relates to improved devices and methods for anchoring umbrellas and similar objects prone to wind exposure. The invention is also suitable for securing a small craft, such as a sail boat, canoe, raft and the like against their being pulled away from the shore by wind, tide and swells created by larger craft in the vicinity.

BACKGROUND OF THE INVENTION

Conventional beach umbrellas suffer from a tendency toward flight during windy conditions, causing at least inconvenience if not out right damage or injury.

The subject system provides a new anchoring system for securing umbrellas during dangerous blowing conditions.

The anchoring device of the present invention works in conjunction with the sand and beach, not against them, just borrow the available sand for ballast and return it when it is time to take down the umbrella. Additionally, in accordance with the invention, an umbrella can be adjusted to almost any angle when it is needed and on all kinds of beach sand, whether rocky, pebbly, hard and compact, soft and powdery or granular.

The subject system provides stability from the top of the umbrella construction, above the umbrella runner and through the spokes of the umbrella support structure. This mechanism eliminates wiggling and wobbling and even in the event that the umbrella tips over, the ballast will keep the umbrella from flying across a beach.

SUMMARY OF THE INVENTION

The subject anchoring apparatus for an umbrella construction has a container or container-like portion for accommodating ballast, and one or more strapping mechanisms for securing weight ballast to a deployed umbrella. One preferred embodiment of the subject design comprises: (a) a generally cylindrical central structure; (b) a bottom panel area securely attached to the cylindrical central structure, the bottom panel having a generally concentric opening to the interior of the central structure adapted to permit an umbrella pole's lower portion to protrude therefrom for placement upon a sand base; (c) an upper opening panel securely attached to the cylindrical central structure, the upper opening panel configured to receive an umbrella pole and an amount of sand sufficient to provide support for the pole and ballast for the umbrella, the upper opening panel having a closure configured to enclose sand ballast and an umbrella pole deployed through the upper panel; and (d) at least one fixed length or adjustable length strap securely attached at one end to the anchor cylindrical central structure of sufficient length to wrap over the umbrella pole runner and engage and secure, as by tying or clasping, the umbrella runner and pole. As used herein "central structure" refers to the principle ballast containing portion of the device, as well as its generally central location. It will be recognized in accordance with the teachings below, the anchoring ballast can be off-set as may be desired in differing deployments of the device and method.

The adjustable length strap is preferably a pair of adjustable straps each securely attached to the anchoring apparatus at one end and each having a complementary clasping device at the other end of each strap. The adjustable straps are fabric webs such as canvas, nylon, cotton, polyester and vinyl fabrics and blends thereof. The complementary clasping devices are preferably snap buckles, and particularly adjustable buckle type connectors, and including cam buckles, and hook and loop fasteners. Preferably, the adjustable strap is securely stitched to the anchoring apparatus at one end thereof. The central structure may utilize one or more pig-tail straps to which longer strapping or webbing may be attached as desired or necessary.

Other shapes for the central structure are possible, each having complementary side, bottom or top panels. Besides the aforementioned cylindrical shape, for example, square and rectangular containers may be utilized.

In preferred embodiments of the subject design of the anchoring apparatus the upper opening panel closure is a drawstring with a cinching barrel clip. The upper opening flap or panel, the central cylindrical panel and the bottom panel are typically fabric panels, securely stitched together. Typically, the subject apparatus will be manufactured by combining separate panel sections; however, larger sections encompassing more than one panel or section at a time may be utilized where convenient or desired. The fabric panels are preferably made of canvas, nylon, cotton, polyester and vinyl fabrics and blends thereof, and may be integrally stitched together from separate panels, or the fabric panels are provided by one or more fabric templates. Two to six hundred denier fabrics have been found to work particularly well in the present application, however other materials, including injection molded plastics can be used to fabricate the central structure.

The one method of anchoring an umbrella on a sand base comprises the steps of: (i) locating a position to place an umbrella; (ii) deploying the lower end of an umbrella pole through an anchoring apparatus, the anchoring apparatus having: (a) a generally cylindrical central structure; (b) a bottom panel area securely attached to the cylindrical central structure, the bottom panel having a generally concentric opening to the interior of the central structure adapted to permit an umbrella pole lower portion to protrude therefrom for placement upon a sand base; (c) an upper opening panel configured to receive an umbrella pole and an amount of sand sufficient to provide support for the pole and ballast for the umbrella, the upper opening panel having a closure configured to enclose the sand ballast and an umbrella pole deployed through the upper panel; and (d) at least one adjustable length strap securely attached at one end to the anchor cylindrical central structure of sufficient length to wrap over and engage one or more ribs of an umbrella construction and around the umbrella pole; (iii) placing the anchoring apparatus with the lower portion of the pole extending there through upon the sand and so that the lower portion of the pole extends into the sand; (iv) filling the anchoring apparatus with sufficient sand to support the umbrella pole and provide ballast; and (v) engaging the upper section of the vertical pole above the ribs of the umbrella with one or more adjustable web straps securely attached at one end to a first point of the anchoring apparatus. In preferred embodiments, the web straps are adjustable in length and are attached at each far end to a second point of the anchoring apparatus.

In other methods and embodiments, an umbrella pole may be affixed to the side of the central container structure providing ballast as well as within and through the central container structure.

The subject improved system may be made and used in accordance with the apparatus and methods described in detail below.

Other objects, features and advantages of the present invention will be apparent when the detailed descriptions of the preferred embodiments of the invention are considered with reference to the accompanying drawings, which should be construed in an illustrative and not limiting sense as follows.

DETAILED DESCRIPTION OF THE PREFERRED EMBODIMENTS

The subject improved apparatus has several important elements as detailed herein below. It will be recognized that many of the fabric panels deployed herein will be stitched together, using hems or piping as appropriate.

Figure 1:
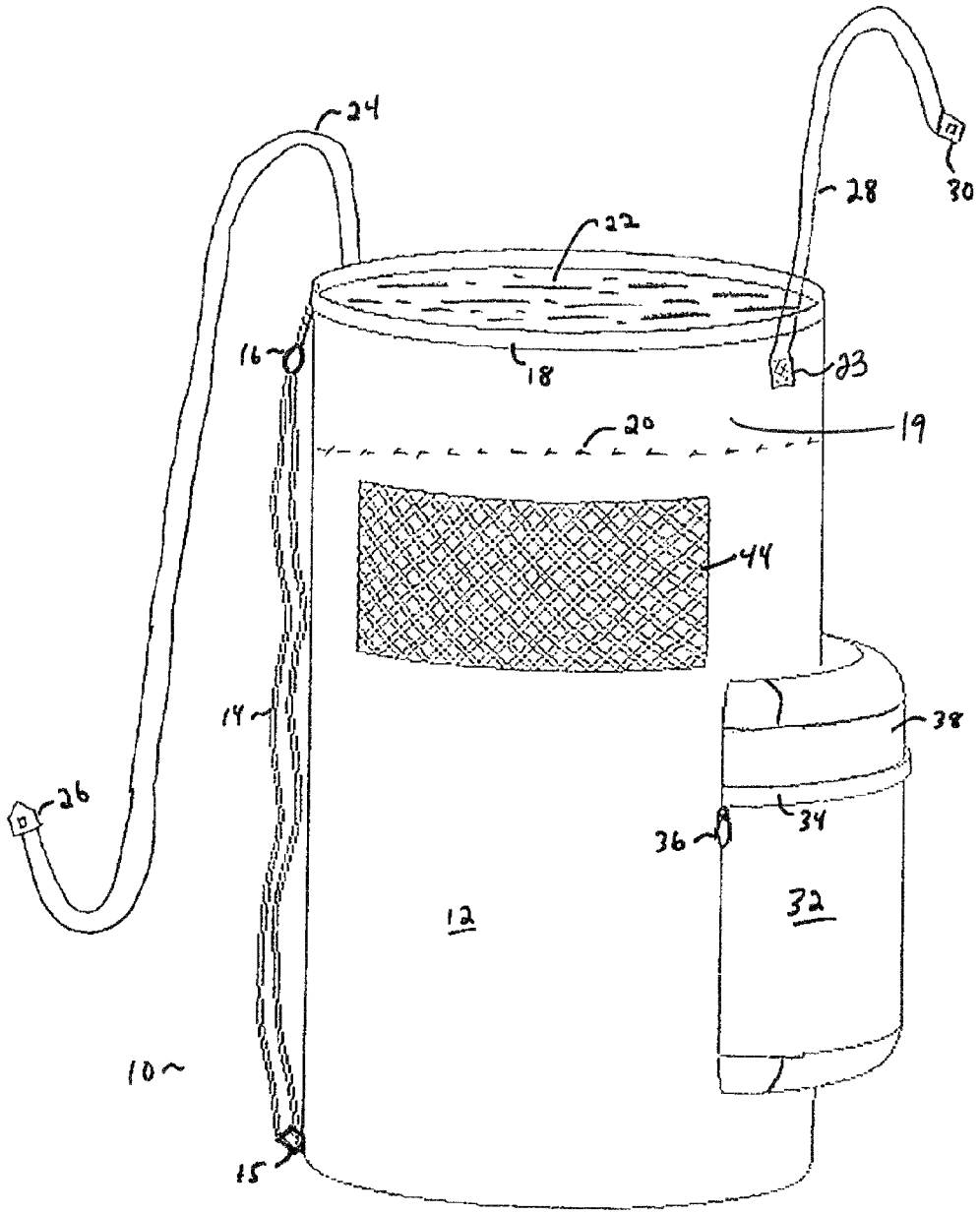
FIG. 1 is a perspective view of one embodiment of the subject apparatus.

The subject anchoring apparatus 10 is shown in FIG. 1. The main compartment will be a generally cylindrical central structure which is preferably a flexible fabric or bag 12 constructed of a versatile fabric or cloth such as canvas or nylon, that will be strong, sturdy, and flexible. Other materials may also be used. Near the top of the flexible bag cylinder 12 is upper opening panel 19. Between the main part of the bag 12 and the upper opening panel 19 is seam 20. It should be recognized that the main cylindrical central structure 12 and the upper opening panel 19 may be constructed of a single integral piece of material, or it may be constructed by separate panels of material. The upper opening panel 19 may have folds, gussets, or pleats sewn into it as well. At the top pf upper opening panel 19 is opening 22 which allows access to the interior of the bag. Around the outer edge of the opening is a tubular hem 18 which will be stitched into the bag 18 as a means of finishing the edge of the opening 22. Further, within the hem 18, a drawstring 14 will be threaded for use in cinching the bag closed during use, as will be described below. The hem 18 will have opening 17 which will allow the drawstring 14 to be threaded through the hem 18 around the top edge of the opening 22. The drawstring 14 will be threaded through a cinching barrel clasp 16. The barrel clasp 16 will preferably be made of plastic but may be made of metal or other suitable material. Optionally, there may be an attachment loop 15 sewn into the base of the bag 12, which may be a loop of fabric, a plastic ring, or any other type of loop for securing the ends of the drawstring 15 to the outer side of the bag 12, thereby preventing the ends of the drawstring from being pulled into the hem 18 or from coming completely unthreaded.

In FIG. 1 showing a preferred embodiment, on the bag 12 is point of attachment 23. At the point of attachment 23, strap 28 is connected to the bag 12. This connection may be made by any suitable and durable means of attaching including rivets, snaps, hook and loop fasteners, adhesives, or stitching. Not seen in the figure is the matching point of attachment connecting strap 24 to the bag 12, which would be connected in the same fashion as point of attachment 23.

The straps 24 and 28, will be made of a strong, durable and flexible material or webbing, such as canvas, nylon or the like. At the loose ends of straps 24 and 28 are complementary buckles 26 and 30 (respectively) that may be adjustably connected. It will be recognized that a variety of means may be used to connect the ends of the straps 24 and 28 to each other, and buckles 26 and 30 may be replaced by any of them, including none. The straps 24 and 28 may be of equal or unequal lengths, and further may also be adjustable. In some alternative embodiments, a single strap may be used. As described further below, the straps will be used to engage the umbrella ribs and upper pole.

Shown in FIG. 1 is an optional mesh pocket 44 made of elastic or stretchable fabric. The mesh pocket 44 may be sewn or glued onto the bag 12, and may be used to store the straps 24 and 28 when the bag is not in use. Further shown in FIG. 1 is an optional accessory pocket 32. The accessory pocket 32 will be sewn or glued onto the outside of bag 12, having in this embodiment a flap 38 over the opening of the pocket, and may optionally have a zipper closure 34. Typically, the zipper 34 would have a zipper pull 36 to facilitate the use of the zipper. Other closures and flap designs may be used. Hook and loop fasteners are also useful in such applications.

It will be recognized that the sand bag anchor may be constructed in a variety of ways from a variety of materials without departing from the spirit of the invention. One such contemplated alternative includes a change of material at optional seam 20 as shown in FIG. 1. Typically seam 20 is the point at which the bag 12 will begin to narrow when the opening 22 is cinched closed. In some embodiments of the sand bag anchor 10, the main part of the bag 12 may be constructed of a hard plastic, or relatively less flexible and sturdier type of material, while the material above seam 20 may be made of any kind of fabric or material, including a relatively less sturdy and more flexible material. A hard plastic container could readily incorporate an injection molded beach cooler. The flexible bag-like containers could incorporate insert bags for convenience in some embodiments, or bladder-like bags could be used to contain liquid ballast.

Figure 2:
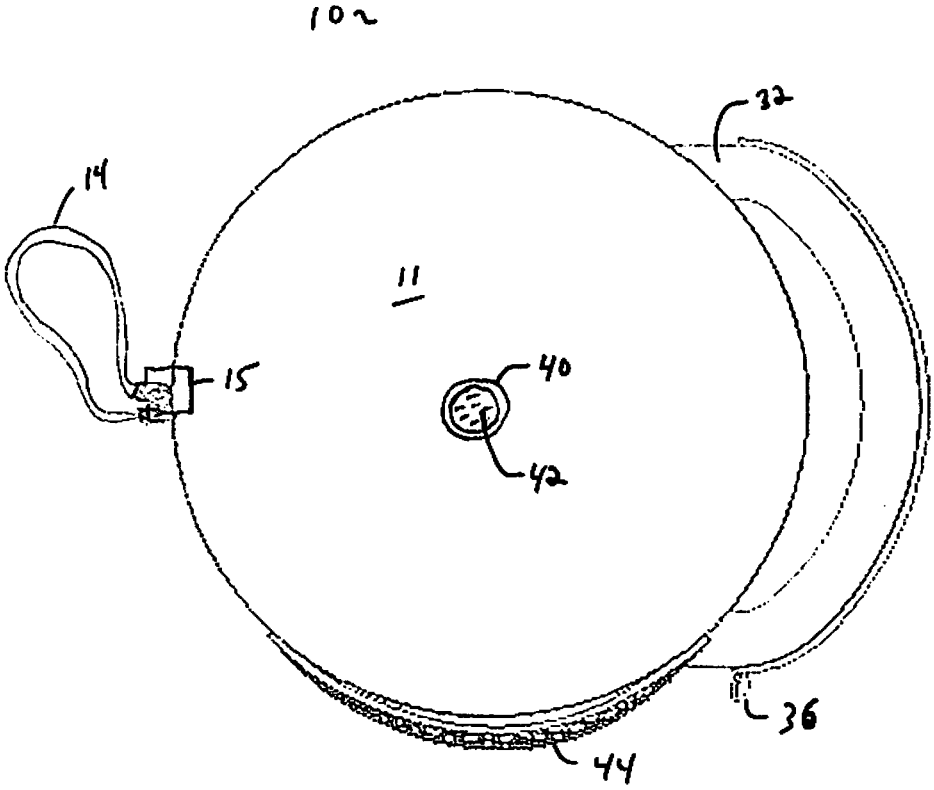
FIG. 2 is a bottom plan view of the apparatus shown in FIG. 1.

In FIG. 2, the bottom plan view of the anchoring apparatus 10 may be seen. In the center of a bottom panel 11 is a concentric opening 42 through which the lower portion of an umbrella pole may protrude when the anchoring apparatus is in use. The edge 40 of the opening 42 will be sturdily stitched with a hem or piping to reinforce the opening and prevent tearing. Also seen in this view is the underside of optional accessory pocket 32, optional zipper pull 36, optional mesh pocket 44, drawstring 14 and the optional loop 15.

Figure 3:
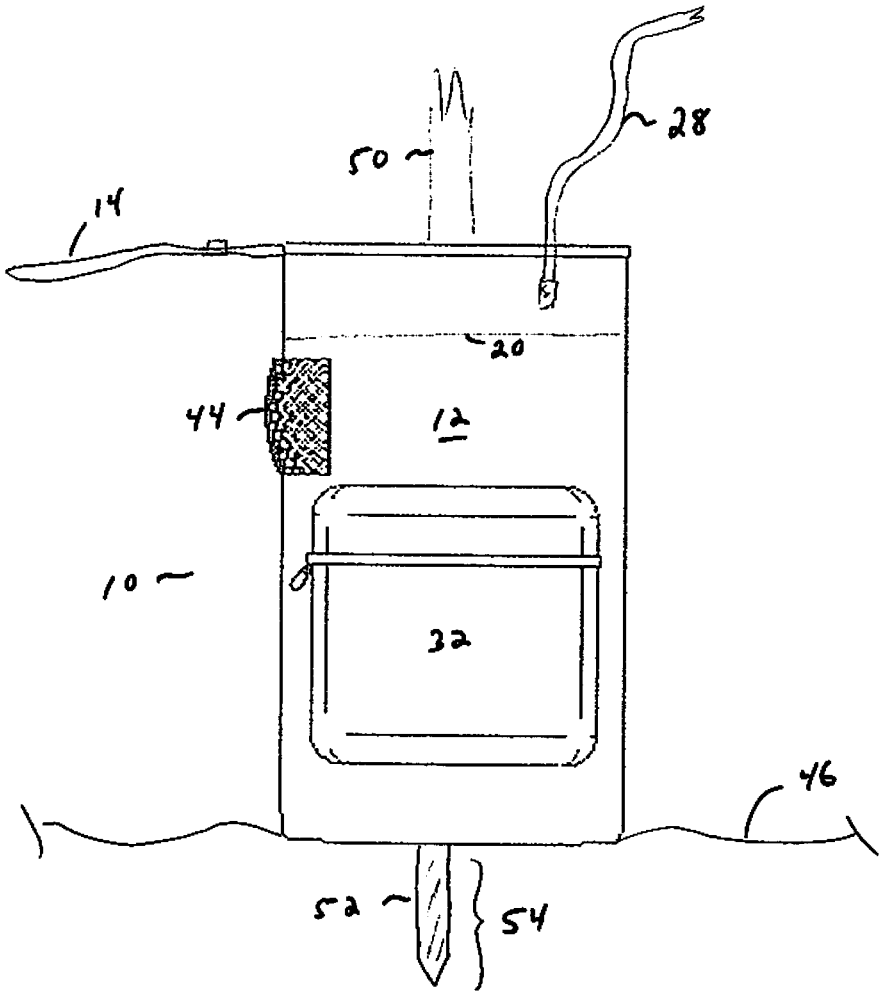
FIG. 3 is an elevated side view of the apparatus shown in FIG. 1 in one stage of the method of use.

FIG. 3 shows an elevated view of the anchoring apparatus 10 as it may be used. The anchoring apparatus 10 has been placed on a sand base 46, and the umbrella pole 50 has been inserted into the apparatus and passed through the hole in the bottom of the apparatus so that the lower portion of the pole 52 may be embedded about 6 to 10 inches down into the sand base 46.

Figure 4:
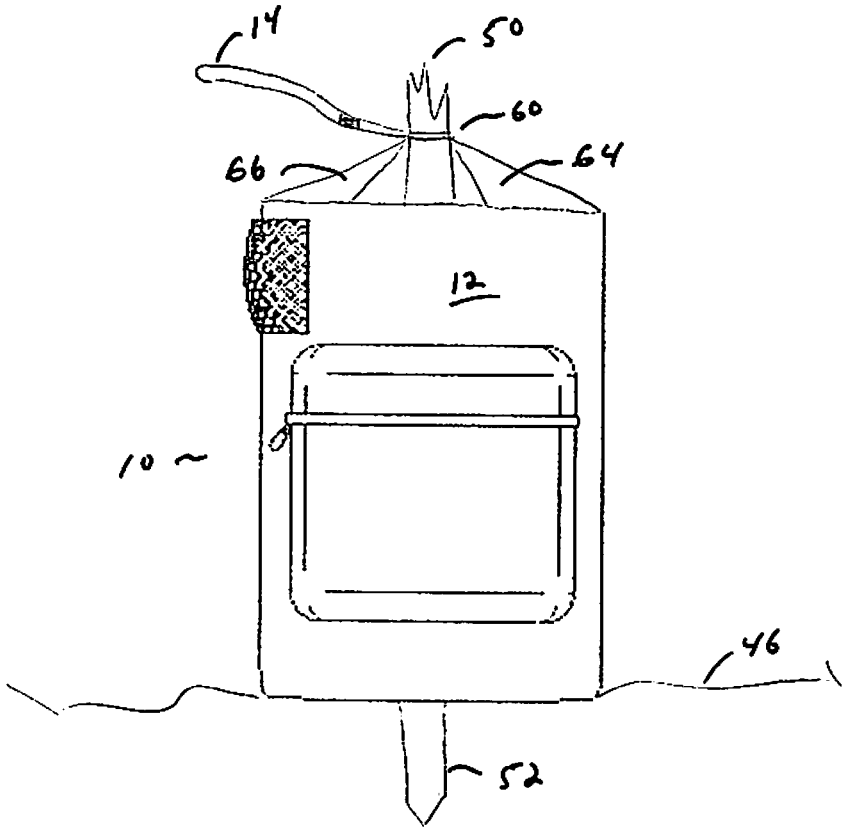
FIG. 4 is an elevated side view of the apparatus shown in FIG. 1 during another stage of the method of use.

FIG. 4 shows the anchoring apparatus 10 as deployed in FIG. 3, in a further step of the method of use. Here, the drawstring 14 has been pulled tight thereby cinching the top opening 60 of the anchoring apparatus. When the top 60 is cinched around the umbrella pole 50, pleats or gussets 66 and 64 are formed, folding in toward the pole. Not shown in this figure is optional cinching barrel clasp 16 which may be used to keep the drawstring 14 cinched closed around the umbrella pole 50.

Figure 5:
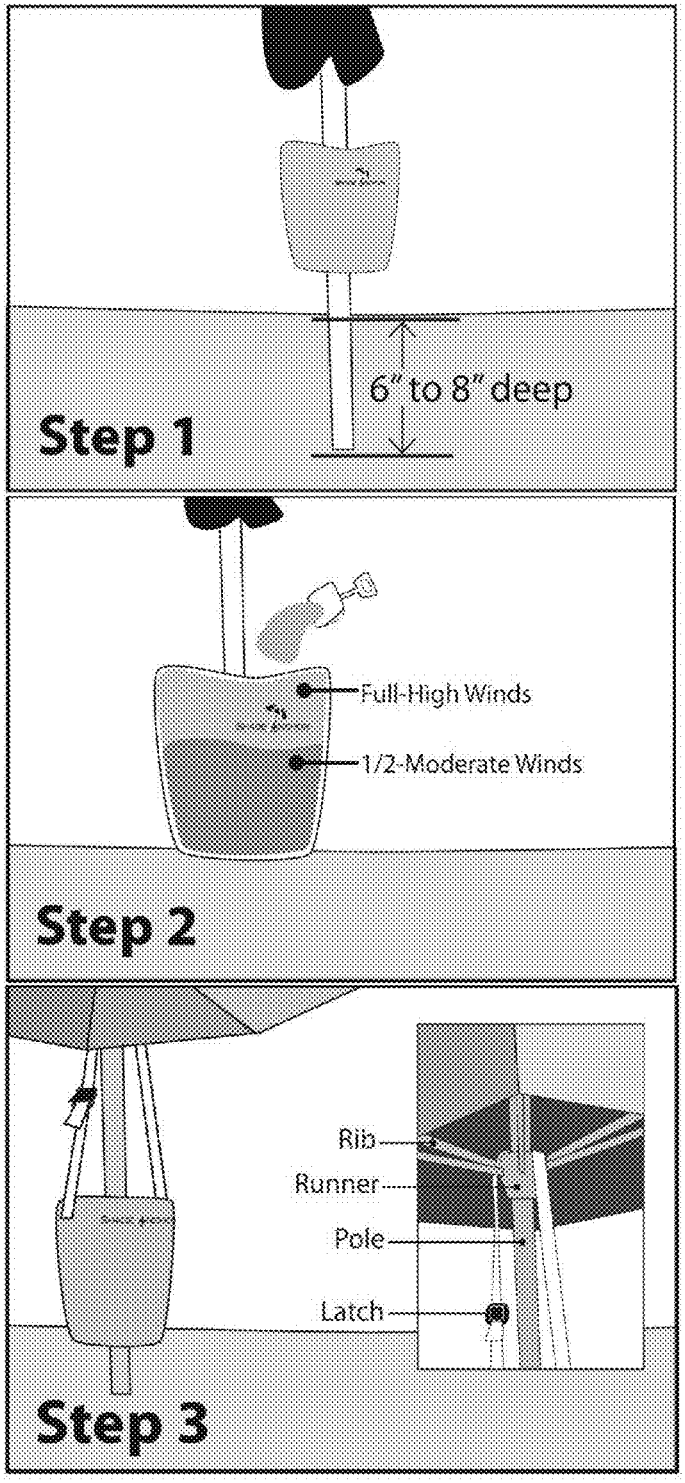
FIG. 5 is an illustration of one method of employing the apparatus.

In FIG. 5, a series of steps are shown illustrating how to use the anchoring apparatus. In Step 1, as shown in FIG. 3, the umbrella pole is passed through the anchoring apparatus, and embedded about 6 to 8 inches into the sand below. In step 2, the anchoring apparatus is filled with sand to support the umbrella pole and act as ballast for the umbrella. Any suitable amount of sand may be used, relative to the environmental conditions. A day with high winds will require more sand to anchor the umbrella than a calm day with no wind. In step 3, the straps are wrapped up and around the umbrella runner and pole and secured with a latch, thereby anchoring the umbrella to the weight of the sand in the anchoring apparatus.

Figure 6:
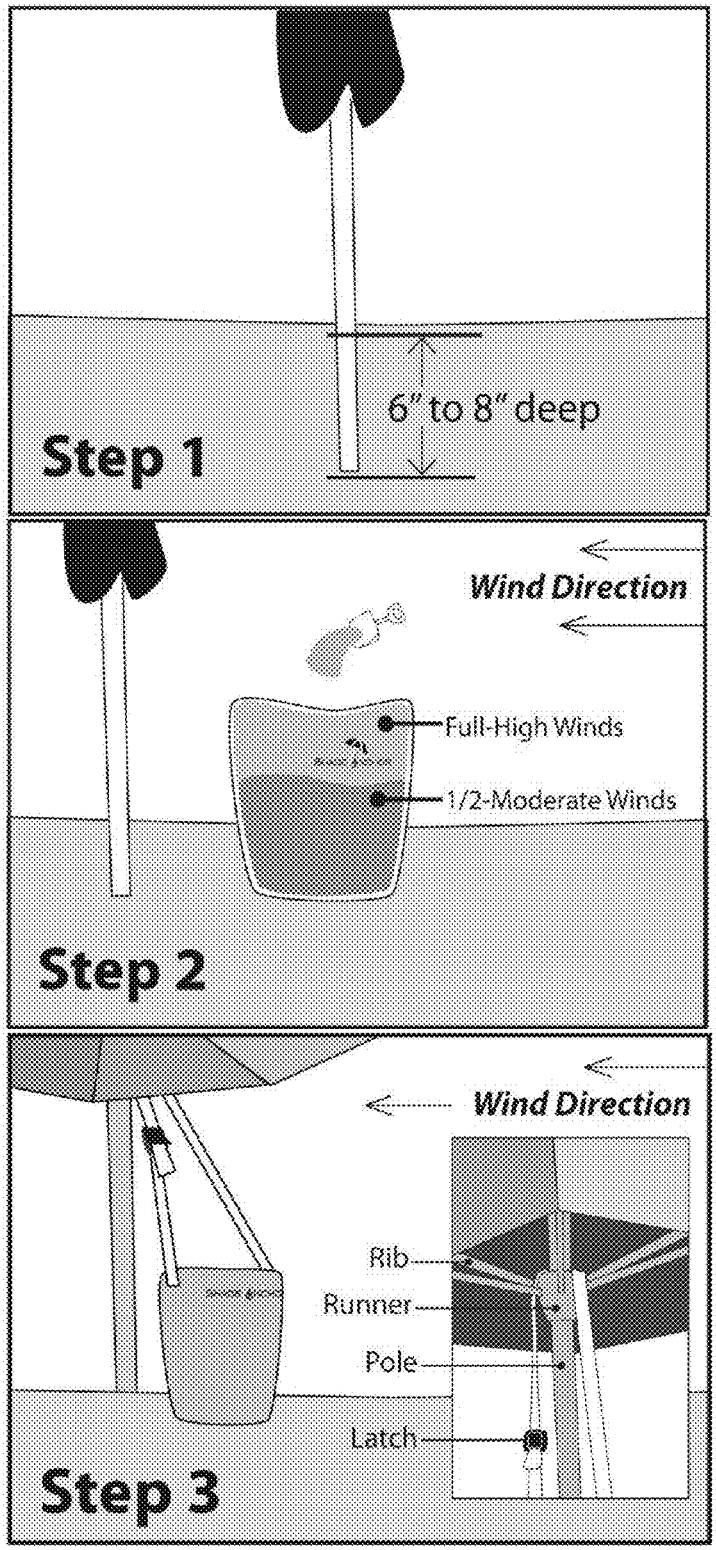
FIG. 6 is an illustration of an additional method of employing the apparatus.

In FIG. 6, an alternative method for using the anchoring apparatus is illustrated. In this method, in step 1, the umbrella is embedded into the sand about 6 to 8 inches deep, without being inserted into the anchoring apparatus. Instead, in step 2, the anchoring apparatus is placed on the windward side of the umbrella, and filled with sand as required by the environmental conditions. Then in step 3 the straps are wrapped up and over the pole runner of the umbrella and secured to the anchoring apparatus as before. Placing the anchoring apparatus slightly windward of the umbrella provides better leverage for balancing the umbrella on a slightly windier than normal day.

There are options for placing the anchor apparatus; first, near the base of an umbrella, like a traditional anchor; or surrounding the umbrella pole, by inserting the pole though the drawstring top and the exit port or hatch at the bottom of the bag. Optionally, a side-mounted tube may guide an umbrella pole past the anchor ballast portion to the sand located below. Alternatively, the anchor structure can be positioned by placing it near the base of the umbrella on the side the wind is coming from.

Figure 7:
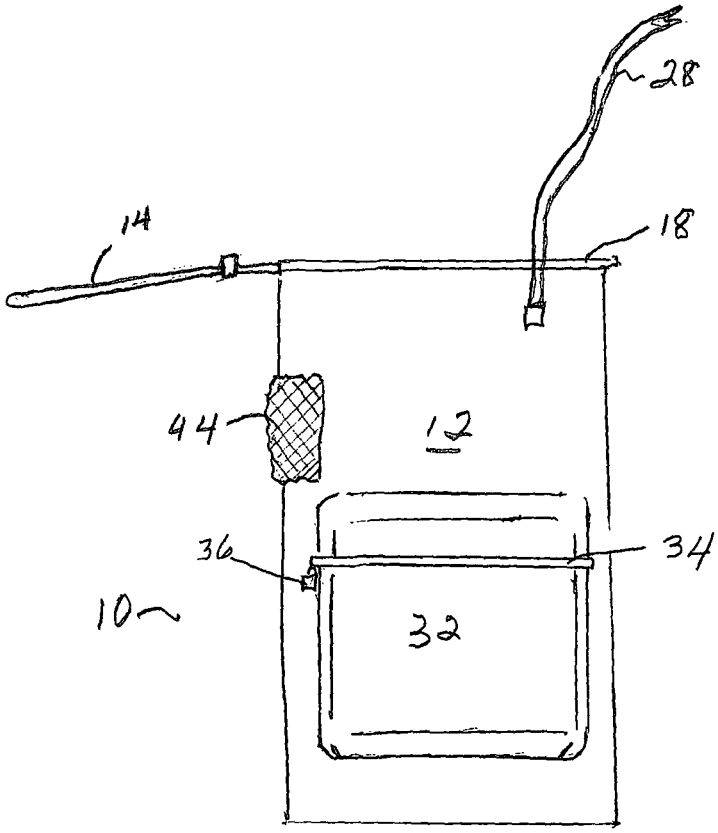
FIG. 7 is a perspective view of another embodiment of the apparatus of the invention wherein the cylindrical central structure and the upper panel are constructed of a single, integral piece of material.

In FIG. 7, another embodiment of the anchor apparatus is shown in which the generally cylindrical central structure is constructed in one piece (no seam) with the upper opening panel. The bottom of the central structure may or may not have a central opening through which the lower portion of an umbrella pole may protrude when the anchor structure is in use. The one-piece structure is otherwise similar to the structure constructed of separate panels in construction and in use.

As mentioned, one or more straps of varying or adjustable length will be affixed to or fastened to the anchor bag. It will be recognized, however, that some embodiments may include umbrellas fitted with or pre-fabricated with strapping affixed thereto for subsequent attachment to the anchoring portion of the apparatus.

Figure 8:
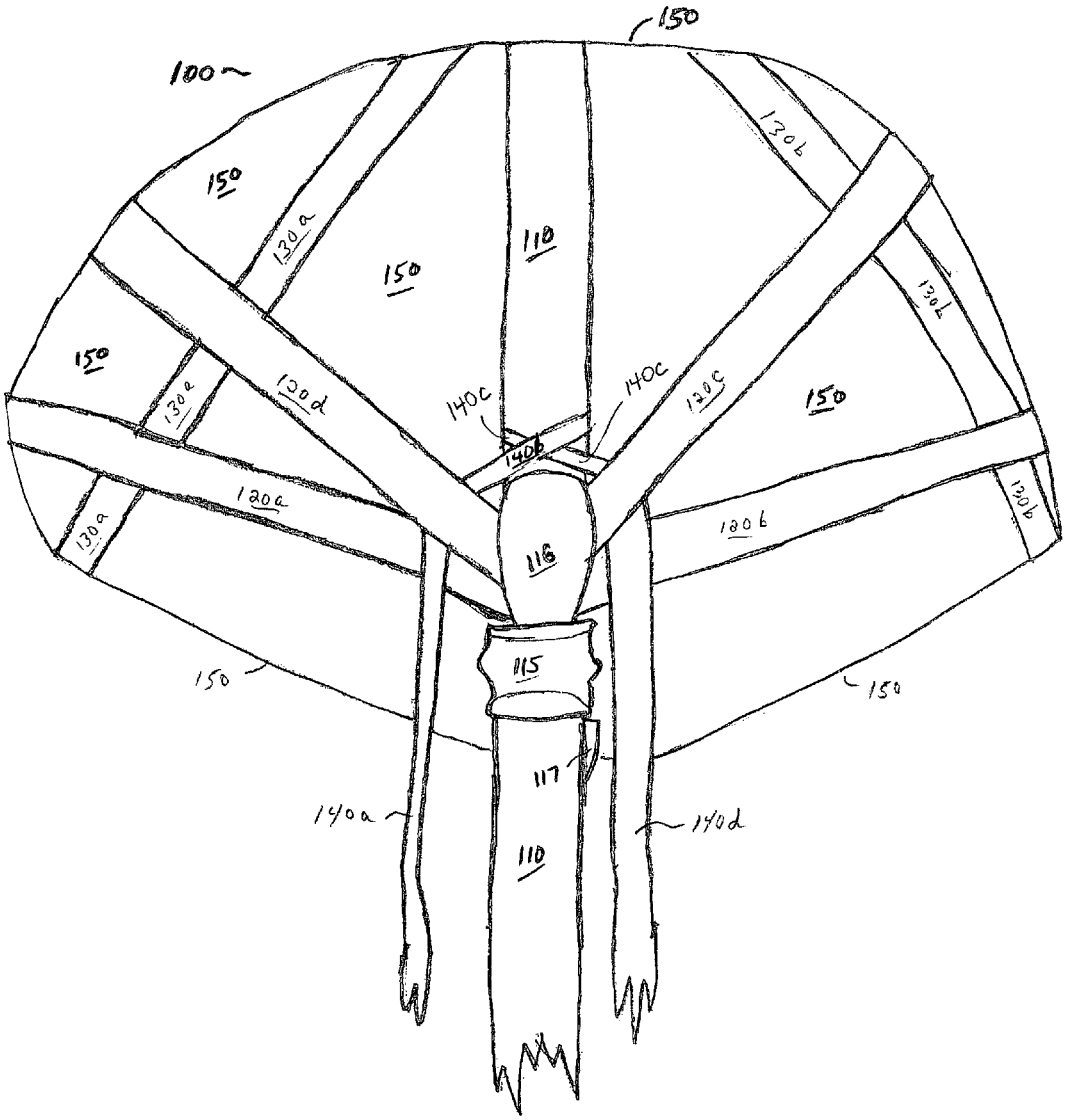
FIG. 8 is a schematic detail depicting an umbrella support structure secured with strapping in another embodiment of the subject apparatus.

In FIG. 8, the underside of an open umbrella is shown, as viewed when looking up into the umbrella mechanism. The umbrella features a portion of a main umbrella pole 110, and an umbrella pole runner having lower portion 115 and upper portion 116. Runner upper portion 116 connects via hinges (not shown) to lower ribs 120*a*, 120*b*, 120*c*, and 120*d*. Runner lower portion 115 engages spring clip 117 in lower pole 110 to maintain the umbrella in an open position. As shown in this figure, upper ribs 130*a* and 130*b* are movably secured to the apex of the umbrella structure (also not shown) and serve to maintain the support and shape of umbrella fabric 150 when the umbrella is deployed for use. In this view, umbrella fabric portion 150 is behind the umbrella structure and a number or portions of such fabric are indicated by reference numerals 150. Further in FIG. 8, it is shown how the strap 140*a-d* of the subject design may be entwined and engaged around the runner 115, 116 and pole 110 structures of the umbrella forming assembly 100. As shown here, one preferred way to use the strap would be by having the first part of the strap 140*a* coming from the subject anchor bag or device at ground level, not shown, being brought up between lower ribs 120*a* and 120*d*, and wrapped around the upper part of umbrella pole 110. This is illustrated as section 140*b* of the strap passing in front of the umbrella pole 110, and then wrapping behind the umbrella pole 110, emerging as strap section 140*c*, which is then threaded between section 140*b* and umbrella pole 110 before being passed back down between lower ribs 120*b* and 120*c* and down to the anchoring device and reattached.

Suitable materials for fabricating the subject anchoring apparatus include nylons, polyesters (e.g. PET) and polyolefin (e.g. PE and PP resins) thermoplastic molding resins, as well as cotton, canvas, plastic film and other cloth materials.

All such materials are commercially available from a variety of sources as are the buckles, strapping and various metal and plastic fasteners. Preferred embodiments will utilize adjustable straps and clasps or similar closures. However, it will be recognized that a strap of sufficient length (e.g. about 12 ft) can be tied via knots and need not use a clasp.

Example

An anchor apparatus was provided substantially in accordance with the description of FIG. 1 above. The bag portion was made of polyester fabric and the straps were made of nylon 600 D webbing material. Approximately 50 pounds of sand ballast was enclosed in the anchor structure which was engaged with typical beach umbrellas of about 4 ft and 9 ft width (i.e. diameter) when open. The anchor structure was shown to maintain umbrella stability in steady wind conditions up to 30 MPH winds, and withstood occasional larger gusts. This embodiment of the anchor also had carrying straps, plastic clips and a zippered pocket to store other items.

The invention now being fully described, it will be apparent to one of ordinary skill in the art that many changes and modifications can be made thereto without departing from the spirit or scope of the invention set forth herein.

The invention claimed is:

1. An anchoring apparatus for an umbrella construction including an umbrella pole, ribs, and runner comprising:

(a) a central ballast container structure having a generally cylindrical central structure;

(b) a complementary bottom panel securely attached or integral to the cylindrical central structure, the bottom panel having a generally concentric opening to the interior of the cylindrical central structure adapted to permit an umbrella pole's lower portion to protrude therefrom for placement upon a sand base;

(c) an upper opening panel securely attached or integral to the cylindrical central structure, the upper opening panel configured to receive an umbrella pole and an amount of ballast sufficient to provide support for the umbrella pole and umbrella pole runner, an upper opening panel having a closure configured to enclose ballast and the umbrella pole runner, and an umbrella pole deployed through the upper opening panel; and (d) at least one fixed or adjustable length strap securely attached at one end to the cylindrical central structure of sufficient length to be extended upward to wrap over and engage one or more ribs of the umbrella pole runner and wrap around the umbrella pole, thereby engaging and anchoring the umbrella construction in an upright position.

2. An anchoring apparatus as in claim 1 wherein the adjustable length strap is a pair of adjustable straps each securely attached to the anchoring apparatus at one end and each having a complementary clasping device at the other end of each strap.

3. An anchoring apparatus as in claim 2 wherein the adjustable straps are fabric webs.

4. An anchoring apparatus as in claim 3 wherein the fabric webs are selected from among nylon, cotton, polyester and vinyl fabrics and blends thereof.

5. An anchoring apparatus as in claim 2 wherein the complementary clasping devices are snap buckles.

6. An anchoring apparatus as in claim 1 wherein the adjustable strap is securely stitched to the anchoring apparatus.

7. An anchoring apparatus as in claim 1 wherein the upper opening panel closure is a drawstring with a cinching barrel clip.

8. An anchoring apparatus as in claim 1 wherein the upper opening panel, the central cylindrical panel and the bottom panel are fabric panels.

9. An anchoring apparatus as in claim 8 wherein the fabric panels are selected from among nylon, cotton, polyester, vinyl fabrics and blends thereof.

10. An anchoring apparatus as in claim 8 wherein the fabric panels are integrally stitched together from separate panels.

11. An anchoring apparatus as in claim 8 wherein the fabric panels are constructed of a single, integral piece of material or separate pieces of material.

12. An anchoring apparatus as in claim 1 wherein the adjustable length strap is a pair of adjustable straps each securely attached to the anchoring apparatus at one end and each having a complementary clasping device at the other end of each strap.

13. An anchor device according to claim 12 wherein the adjustable straps are pig-tail straps.

14. A method of anchoring an umbrella on a sand base comprising the steps of;

(a) locating a position to place the umbrella, including an umbrella pole and a runner;

(b) deploying a lower end of the umbrella pole through an anchoring apparatus, the anchoring apparatus having a. a central ballast container structure; b. a complementary bottom panel securely attached to the central ballast container structure, the bottom panel having a generally concentric opening to the interior of the central ballast container structure adapted to permit an umbrella pole lower portion to protrude therefrom for placement upon a sand base; c. an upper opening panel configured to receive an umbrella pole and an amount of sand sufficient to provide support for the pole and ballast for the umbrella, the upper opening panel having a closure configured to enclose the sand ballast and an umbrella pole deployed through the upper panel; and d. at least one fixed or adjustable length strap securely attached at one end to the anchor central structure of sufficient length to extend upward to wrap over the umbrella pole runner and securely engage the umbrella pole (c) positioning the lower end of the pole in the sand and placing the anchoring apparatus with pole there through into the sand;

(d) filling the anchoring apparatus with sufficient sand to support the umbrella pole and provide ballast; and (e) engaging and securing the umbrella pole runner and pole with one or more fixed or adjustable web straps securely attached at one end to a first point of the anchoring apparatus.

15. The method of claim 14 wherein the web straps are adjustable in length and attached at each far end to a second point of the anchoring apparatus.

16. The method of claim 15 wherein the web straps have complementary clasps for fastening or adjusting the straps.

17. An anchoring apparatus for an umbrella including an umbrella pole, ribs, and a runner comprising:

(a) a rigid central ballast container structure, said central ballast container structure having a bottom panel having a generally concentric opening to an interior of the central ballast container structure adapted to permit an umbrella pole's lower portion to protrude therefrom for placement upon a sand base;

(b) an upper opening panel securely attached or integral to the central ballast container structure, the upper opening panel configured to receive an umbrella pole and an amount of ballast sufficient to provide support for the umbrella pole and ballast for the umbrella, the upper opening panel having a closure configured to enclose ballast, the umbrella pole and umbrella pole runner deployed through the upper panel; and (c) at least one fixed or adjustable length strap securely attached at one end to the cylindrical central structure of sufficient length to be extended upward to wrap over and engage one or more of the ribs and the umbrella pole runner and around the umbrella pole, thereby engaging and anchoring the umbrella construction in an upright position.

18. An anchoring apparatus as in claim 17 wherein the adjustable length strap comprises a pair of adjustable straps each securely attached to the anchoring apparatus at one end and each having a complementary clasping device at the other end of each strap.

19. An anchoring apparatus as in claim 17 wherein the rigid central ballast container structure is an injection molded insulating container.

* * * * *